United States Patent [19]

Murray et al.

[11] Patent Number: 4,729,855

[45] Date of Patent: Mar. 8, 1988

[54] METHOD OF DECONTAMINATING RADIOACTIVE METAL SURFACES

[75] Inventors: Alexander P. Murray, Murrysville; Clifton G. Slater, Wilkinsburg, both of Pa.

[73] Assignee: Westinghouse Electric Corp., Pittsburgh, Pa.

[21] Appl. No.: 803,024

[22] Filed: Nov. 29, 1985

[51] Int. Cl.[4] ..... G21F 9/00

[52] U.S. Cl. ..... 252/626; 376/309; 376/310; 134/2

[58] Field of Search ..... 252/626, 631; 134/2, 134/22.14, 22.19; 376/309, 310, 313

[56] References Cited

U.S. PATENT DOCUMENTS

| | | | |
|---|---|---|---|
| 3,297,580 | 1/1967 | Pitzer | 252/626 X |
| 3,873,362 | 3/1975 | Mihram et al. | 376/310 X |
| 4,252,959 | 2/1981 | Spitzner . | |
| 4,512,921 | 4/1985 | Anstine et al. | 252/626 |

FOREIGN PATENT DOCUMENTS

| | | | |
|---|---|---|---|
| 1062590 | 9/1979 | Canada | 376/309 |

OTHER PUBLICATIONS

Tallent et al., "An Alternate Solvent Cleanup Method Using a Hydrazine Oxalate Wash Reagent", Nuclear Tech., vol. 59, Oct. 1982, pp. 51–62.

*Primary Examiner*—John F. Terapane
*Assistant Examiner*—John S. Maples
*Attorney, Agent, or Firm*—R. D. Fuerle

[57] ABSTRACT

Disclosed is a method of decontaminating metal surfaces contaminated with a radioactive deposit by passing over the coating an aqueous solution of a water soluble condensation reaction product of (1) a hydrazine compound having the general formula

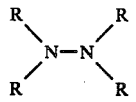

where each R group is independently selected from hydrogen and alkyl to $C_4$ and (2) a water soluble aliphatic polycarboxylic acid. The method includes the additional last steps of passing an aqueous oxidizing solution over the deposit followed by passing a decontamination solution over the deposit a second time. The solution is circulated through a cationic exchange column which can be preloaded with hydrazine ion. The decontamination solution can be decomposed by the addition of an oxidant to form nitrogen, carbon dioxide, and water.

17 Claims, No Drawings

METHOD OF DECONTAMINATING RADIOACTIVE METAL SURFACES

BACKGROUND OF THE INVENTION

As nuclear reactors are operated, metal surfaces gradually corrode, and become coated with highly radioactive deposits. In order to operate the reactor properly and to perform maintenance on it, it is necessary to remove these radioactive deposits. This is generally accomplished by the use of chemical decontamination processes. In these processes, aqueous solutions containing chelants and organic acids are passed over the metal surfaces to solubilize and remove the compounds that form the deposits. While these processes are effective in decontaminating the metal surfaces, the chelants used in the processes end up as part of the radioactive process waste and must be disposed of as radioactive waste. Unfortunately, most burial sites for radioactive waste have maximum levels on the chelants and organic acids which are permissible in the waste. As a result, either the waste must be specially disposed of at increased cost or the chelants and organic acids must be removed from the waste before it is sent to the burial site.

SUMMARY OF THE INVENTION

We have discovered that the condensation product of hydrazine, or a derivative thereof, with a polycarboxylic acid, acts as a chelant for metal ions and will effectively decontaminate radioactive deposits on metal surfaces. An aqueous solution of this condensation product is circulated between the deposit on the metal surface and a cationic ion exchange resin, where the chelated metal ions are deposited. The ion exchange resin can be preloaded with the hydrazine portion of the condensation reaction product to prevent the deposition of that portion onto the column in preference to the metal ions. We have found that the decontamination solution of this invention, when exhausted, can be oxidized to form nitrogen, carbon dioxide, and water, so that the resulting waste contains neither chelants nor organic acids, and can be deposited at nuclear waste burial sites.

DESCRIPTION OF THE INVENTION

It is an object of the process of this invention to reduce the radioactivity of metal surfaces having radioactive deposits thereon. This is accomplished by passing over the surface an aqueous solution that contains the water soluble condensation reaction product formed when a water soluble aliphatic polycarboxylic acid reacts with a hydrazine compound having the general formula:

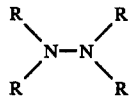

where each R group in the formula is independently selected from hydrogen and alkyl to $C_4$. The R group is preferably hydrogen because when the R group is alkyl, an alcohol is emitted (instead of water) which creates an additional handling problem and, also, the hydrogen compound, hydrazine, is more effective.

The water soluble aliphatic polycarboxylic acid may be any aliphatic organic acid containing two or more carboxylic acid groups which will react with the hydrazine compound to form a condensation reaction product. Preferably, the polycarboxylic acid contains two carboxylic acid groups, as those compounds tend to be more soluble and more easily oxidized, and are more reactive with the hydrazine compound. The preferred polycarboxylic acid is oxalic acid, although tartaric acid, citric acid, nitrilotriacedic acid, ethylenediaminetetraacedic acid, succinic acid, and other polycarboxylic acids can also be used.

The condensation reaction product can be formed by stoichiometrically reacting (plus or minus about 10 mole percent) the hydrazine compound with the aliphatic polycarboxylic acid. It is preferable to react one mole of the hydrazine compound for each equivalent of the polycarboxylic acid so that each carboxylic acid group on the aliphatic polycarboxylic acid is reacted with one hydrazine compound molecule. However, it is also possible to leave some free carboxylic acid groups on the condensation reaction product by reacting less than one mole of the hydrazine compound with each equivalent of the polycarboxylic acid. A one-to-one equivalent ratio is preferred as it seems to produce a stronger chelant. Thus, dihydrazine oxalate is preferred to mono-hydrazine oxalate. The reaction will proceed without a catalyst in water at about a 5% concentration between room temperature and about 50° C., and is complete in about one to four hours. The resulting solution can be used directly, or it can be evaporated to solids and the solids used to form the decontamination solution.

The decontamination solution is formed by making an aqueous solution of the condensation reaction product at a concentration of about 0.05 to about 10% by weight based on total solution weight; less than about 0.05% is ineffective and more than about 10% is unnecessary. The decontamination solution is circulated over the deposit on the metal surface for about 2 to 24 hours at a temperature of about 80° to about 125° C., though times and temperatures can vary as desired.

After the solution has contacted the deposit, it is passed through a cationic ion exchange column to remove whatever metal ions have been chelated by the condensation reaction product. The cationic ion exchange resin can be formed with a strong acid or a weak acid, and can be loaded with a variety of cations, but it is preferable to load the column with $N_2H_5^+$ or the cationic moiety of the condensation reaction product. For example, if $N_2H_3CH_3$ is used to form the condensation reaction product, the cationic exchange column would be loaded with $N_2H_5^+$ or, preferably, with $N_2H_4CH_3^+$, to prevent the hydrazine moiety of the condensation reaction product from being loaded onto the column in preference to the chelated metal ions. A further advantage of preloading the ion exchange column with the cationic moiety of the condensation reaction product is that an excess of that moiety is a reducing agent and reduces metal ions, such as ferric, to less corrosive and more soluble forms, such as ferrous.

If metal surfaces from a pressurized water reactor, such as steam generator tubes, are to be treated, is it preferable to follow the decontamination solution with a rinsing, then with an oxidizing solution, followed by a second rinse and a second treatment with the decontamination solution. This three step procedure is more effective in reducing decontamination, and results in a larger decontamination factor (DF, radioactivity before treatment divided by radioactivity after treatment). Oxidizing solutions are well known in the art and typically include alkali permanganates (i.e., mixtures of alkali metal hydroxides and alkali metal permanganates), such as an aqueous solution of 2% potassium permanganate and 10% sodium hydroxide. If the metal surfaces are from a boiling water reactor, the oxidation step, while it may be useful, can be omitted.

When the decontamination solution is exhausted or must be disposed of, it is mixed with an oxidizing agent which oxidizes the condensation reaction product to nitrogen, carbon dioxide, and water. Suitable oxidizing agents include ozone and hydrogen peroxide. Hydrogen peroxide is preferred as it is readily available, inexpensive, and produces a minimum amount of solids. The oxidant should be added at a concentration of preferably between about stoichiometric and about 10 mole percent in excess of stoichiometric, although up to five times stoichiometric can be used. If the metal surfaces are treated with a separate oxidizing solution, such as an alkali permanganate, the decontamination solution may be mixed with the alkali permanganate solution to destroy the condensation reaction product.

If an "R" group in the above general formula is alkyl, a higher temperature and oxidant concentration will be required to fully oxidize the condensation reaction product to gases than if the "R" groups are all hydrogen.

The following examples further illustrate this invention.

EXAMPLE

A hydrazine oxalate condensation reaction product was prepared by adding 37.43 grams of hydrazine and 52.63 grams of oxalic acid to 1000 milliliters of water. The mixture was heated at 50° C. for four hours and was then evaporated to dryness under a vacuum at 50° C. to produce a white powder of hydrazine oxalate.

A decontamination solution was prepared by adding 2.459 grams of the hydrazine oxalate to 700 milliliters of water to form a 0.35 percent by weight hydrazine oxalate solution. The solution was heated to 90° C. An actual pressurized water reactor Inconel tube specimen having a radioactive deposit thereon was placed in the heated solution for two hours without agitation. The specimen was removed, rinsed, and placed in a 5% solution of 0.83% potassium permanganate and 4.17% sodium hydroxide for two hours at 95° C. without agitation. The specimen was rinsed and again placed in fresh hydrazine oxalate decontamination solution again for two hours at 90° C. with no agitation. A decontamination factor of 8.06 was obtained with most of the activity removal occurring in the last step. This is regarded as a good result considering that the specimen was exposed for only two hours, at a low concentration, without agitation, and at only 90° C.

We claim:

1. A method of decontaminating metal surfaces contaminated with a radioactive deposit, comprising circulating between said deposit and a cationic ion exchange column an aqueous solution of a water soluble condensation reaction product of (1) a hydrazine compound having the general formula

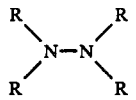

where each R is independently selected from hydrogen and alkyl to $C_4$; and (2) a water-soluble aliphatic polycarboxylic acid selected from the group consisting of oxalic acid, tartaric acid, citric acid, succinic acid, and mixtures thereof.

2. A method according to claim 1 wherein said water-soluble aliphatic polycarboxylic acid is oxalic acid.

3. A method according to claim 1 wherein one mole of said hydrazine compound is reacted with one equivalent of said polycarboxylic acid.

4. A method according to claim 1 wherein the concentration of said condensation reaction product in said aqueous solution is about 0.05 to about 10% by weight, based on total solution weight.

5. A method according to claim 1 wherein the temperature of said aqueous solution is about 80° to about 125° C.

6. A method according to claim 1 including the additional last step of adding an oxidant to said aqueous solution.

7. A method according to claim 1 wherein said R group is H and said cationic exchange resin is loaded with $N_2H_5^+$.

8. A method according to claim 1 wherein said cationic ion exchange column is preloaded with the cationic moiety of said condensation reaction product.

9. A method according to claim 1 wherein said water-soluble aliphatic polycarboxylic acid is citric acid.

10. A method according to claim 1 wherein said water-soluble aliphatic polycarboxylic acid is tartaric acid.

11. A method according to claim 1 wherein said water-soluble aliphatic polycarboxylic acid is succinic acid.

12. A method according to claim 1 wherein each R is hydrogen.

13. A method according to claim 12 wherein said water-soluble aliphatic polycarboxylic acid is oxalic acid.

14. A method according to claim 1 including the additional last steps of passing an aqueous oxidizing solution over said deposit, followed by passing said aqueous solution iover said deposit a second time.

15. A method according to claim 14 wherein said oxidizing solution is a solution of an alkali metal hydroxide and an alkali metal permanganate.

16. A method of decontaminating a metal surface having a deposit thereon that contains radioactive elements, comprising (1) preloading a cationic ion exchange column with $N_2H_5^+$;

(2) circulating between said deposit and said cationic exchange column, an aqueous solution iof dihydrazine oxalate, at a concentration of about 0.05 to about 10% by weight, based on solution weight, heated to about 870° to about 125° C.;

(3) passing an oxidizing solution over said deposit;

(4) repeating step (2); and (5) adding an oxidant to said aqueous solution, whereby said dihydrazine oxalate is oxidized to nitrogen, carbon dioxide, and water.

17. A method according to claim 16 wherein said oxidant is hydrogen peroxide.

* * * * *